United States Patent [19]

Janzen et al.

[11] 4,445,403

[45] May 1, 1984

[54] POWER TONGS

[75] Inventors: Harlo W. Janzen; Melvin J. Kliewer, both of Fairview, Okla.

[73] Assignees: Larry D. Kliewer; Glenn A. Kliewer, both of Fairview, Okla.

[21] Appl. No.: 362,897

[22] Filed: Mar. 29, 1982

[51] Int. Cl.[3] ..... B25B 17/00

[52] U.S. Cl. ..... 81/57.18; 81/57.2; 81/57.21

[58] Field of Search ..... 81/57.18, 57.2, 57.21; 188/251 A; 308/299, 297

[56] References Cited

U.S. PATENT DOCUMENTS

| | | | |
|---|---|---|---|
| 4,084,453 | 4/1978 | Eckel | 81/57.18 |
| 4,215,602 | 8/1980 | Carstensen et al. | 81/57.18 |
| 4,266,450 | 5/1981 | Farr et al. | 81/57.18 |
| 4,291,598 | 9/1981 | Cherry | 81/57.18 |

*Primary Examiner*—James L. Jones, Jr.

*Attorney, Agent, or Firm*—Laney, Dougherty, Hessin & Beavers

[57] ABSTRACT

A power tong which includes a frame and a pipe-gripping mechanism associated with a throat at one end of the frame. Power is transmitted to the pipe-gripping mechanism from a power unit through a drive train. The pipe-gripping mechanism cooperates with the throat to receive a pipe section to be rotated and includes a partial ring rotatably mounted within the frame and having an opening which may be aligned with the throat. The ring may be rotated in either direction by the power unit. Mounted on the tong is a die carrier which is rotatable relative to the ring. A pair of graphite impregnated polyurethane bearing quadrants are provided to facilitate rotation of the ring upon the frame, and graphite impregnated polyurethane bearing rings are provided to facilitate relative rotation between the die carrier and the partial ring.

22 Claims, 4 Drawing Figures

POWER TONGS

BACKGROUND OF THE INVENTION

1. Field of the Invention

This invention relates to power tongs used for making up and breaking apart the threaded connections used to interconnect sections and lengths of drill pipes, casings and tubular elements of the sort employed in drilling and completing oil and gas wells.

2. Brief Description of the Prior Art

Many types of power tongs have heretofore been constructed and marketed, each having as its purpose, the engagement of drill pipes used in drilling oil and gas wells in order to permit a section of the drill pipe to be threaded up tightly into an aligned, serially connected section by means of a threaded joint. One more recent type of power tong construction which has been utilized, and which typifies other constructions in its general aspects, is that which is shown in Eckel U.S. Pat. No. 4,084,453. The Eckel power tong, as well as others now marketed, includes a frame which carries a pipe gripping and rotating mechanism. The frame and the pipe gripping mechanism include aligned throats which permit the tong to be centered around a pipe section. After such centering is accomplished by passage of the pipe section through the aligned throat sections, a partial ring carried on the power tong housing is rotated with respect to the housing in either a clockwise or a counterclockwise direction by a power unit also carried on the housing. After the ring has rotated for a certain distance, cam surfaces carried on the ring actuate link members which are carried on a die carrier also rotatably mounted on the power tong housing for rotation relative to the ring. Further and continued rotation of the ring causes the dies carried by the die carrier to engage the pipe section. After this, further movement of the ring on the housing also causes rotation of the die carrier, and the pipe section thus engaged is rotated to make up or break apart a threaded joint of pipe.

In power tongs of the type described, it has been customary to use circumferentially spaced roller bearings for the purpose of rotatably supporting and guiding during rotational movement, the power driven ring which is rotatably supported on the power tong housing. Roller bearings are also employed for supporting the die carrier for rotation relative to both the housing and the power driven ring.

The arrangement of the roller bearings described within the power tong construction is such that the roller bearings are individually and disproportionately impacted with variously differing forces as a pipe joint passes through the mouth or opening into the power tong and slams against the ring and die carrier. The forces imposed on these rollers may also be unequal during rotation of the pipe section so that one roller is loaded more heavily than the other, and thus fails at an earlier time or has a reduced or shortened service life as compared to other rollers in the set. Moreover, the rollers, in being spaced apart, do not afford continuous and firm support to the rotating mechanical elements within the power tong, and the individual rollers are susceptible to impaction by grit, grease and contact with other deleterious surfaces so that they become jammed and undergo failure due to inability to rotate during use of the tong, thus burning out individual bearings and causing the need to provide maintenance of the power tong after a relatively short time in service.

The spaced roller bearings also, in being intermittently traversed and covered by moving parts of the tong, enable a hazardous condition to exist in which the fingers of operating personnel may be caught and crushed or severely injured.

BRIEF DESCRIPTION OF THE PRESENT INVENTION

The present invention provides an improved power tong construction in which the partial ring driven from the power source by the drive train provided in the tong is rotatably supported upon the tong frame by means of a pair of graphite impregnated polyurethane bearing ring quadrants or segments. The die carrier is rotatably supported on the housing by means of at least one graphite impregnated polyurethane annular bearing ring which is substantially coextensive in its overall circumferential dimension with the die carrier. In a preferred embodiment of the invention, the tong is also provided with a molded polyurethane brake band which has fine chips of wood embedded therein.

An important object of the present invention is to provide an improved power tong for gripping and rotating sections of drill pipe or the like, which tong includes semi-continuous arcuate bearing elements for rotatably mounting therein, a power driven, rotatable partial ring, and which also includes an improved bearing structure employed for rotatably mounting and guiding a die carrier mounted on the tong, and rotatable relative to the power driven ring.

Another object of the invention is to provide a power tong which is characterized in having an extended operating life, and which requires relatively little maintenance during its extended usage.

A further object of the invention is to provide a power tong which can be more economically constructed, and which requires less expensive maintenance, than power tongs as now constructed.

Another object is to provide an improved power tong structure in which accessible space between novel bearing elements and moving structure supported thereon is minimized, thus improving the safety with which the power tong can be used.

Further and additional objects will become apparent as the following detailed description of a preferred embodiment of the invention is read in conjunction with the accompanying drawings which illustrate such preferred embodiment.

GENERAL DESCRIPTION OF THE DRAWINGS

DETAILED DESCRIPTION OF A PREFERRED EMBODIMENT OF THE INVENTION

Figure 1:
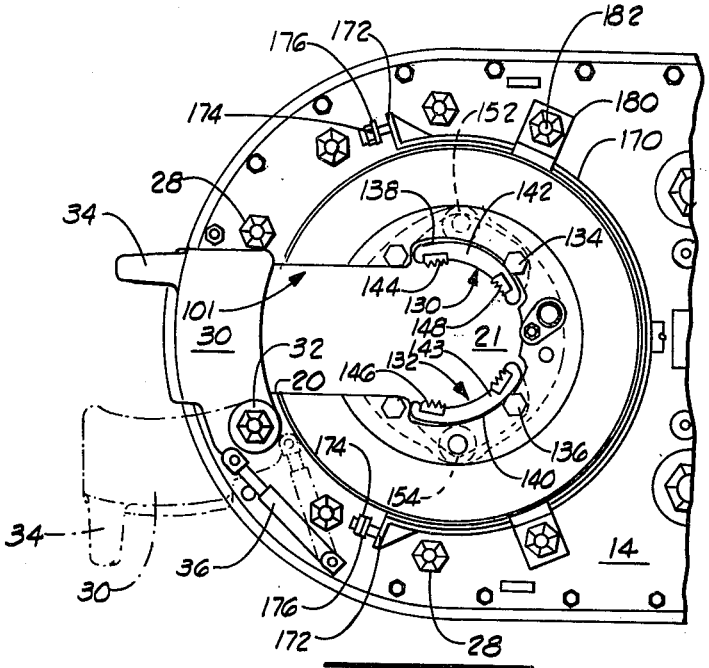
FIG. 1 is a top plan view of the front or pipe receiving portion of a power tong constructed in accordance with the present invention.

The power tong, as illustrated in the drawings, includes a frame 10 formed by an upper frame plate 14 and a lower frame plate 16 interconnected by side wall 18 to which these frame plates are bolted. The frame 10 has an arcuate pipe-side which defines an opening or a throat 20 for receiving a pipe section, typified by drill pipe, casing or other tubular goods used in the drilling and completion of oil and gas wells. Such pipe section can pass through the throat 20 into a circular opening 21 in the center of the frame. On opposite sides of the throat or opening 20, and mounted immediately inside the side walls 18 are a pair of arcuate bearing and guide segments 22 and 24.

Each of the arcuate bearing and guide quadrants or segments 22 and 24 is formed on an arc of a circle extending over at least 90° of arc, and preferably approximately 120° of arc, and each is formed of a block of graphite impregnated polyurethane material, hereinafter described in greater detail. Each of the arcuate bearing and guide segments 22 and 24 is of generally rectangular cross-section and is provided with a rectangular raceway recess 26 at its radially inner side as illustrated in FIG. 4. The bearing and guide segments are secured in the position illustrated in FIGS. 3 and 4 by means of a plurality of bolts 28 passed through the upper and lower frame plates 14 and 16 of the housing 10. The bolts 28 are extended through the segments at central locations aligned along a radial center line of the respective segments.

A door 30 is pivotally mounted to the frame 10 adjacent the throat or opening 20 by means of a hinge pin 32. The door 30 is openable by the use of a handle 34 to allow the pipe which is to be gripped by the power tongs to be inserted through the throat 20. One end of a spring loaded piston assembly 36 is attached to the door 30, and the other end of the piston assembly 36 is pivotally attached to the frame in order to retain the door in either an open or a closed position. The door 30 and piston assembly 36 are constructed and function in substantial accordance with the description of these same elements appearing in U.S. Pat. No. 4,084,453, which is incorporated herein by reference, and the open and closed positions of the door are shown in dashed lines and full lines, respectively, in FIGS. 1 and 2.

The mechanism which is provided for gripping the pipe in order to cause it to undergo rotation includes a partial ring 38 which is mounted for rotation relative to the frame 10 and which has an opening 40 of substantially the same size as, and adapted for alignment with, the throat 20 of the frame 10. The ring 38 is guided along its outer periphery and retained within the frame 10 by the bearing and guide segments 22 and 24. More particularly, the ring 38 includes a projection 44 which extends radially outwardly from its outer periphery (around the outer circumference of the ring) and defines upper and lower shoulders 46 and 48, respectively, which abut against the upper and lower sides of the raceway recess 26 formed in the radially inner side of each of the segments 22 and 24. Rigidly secured to the outer periphery of the projection 44 of the ring 38 are gear teeth 50. It will be noted that the bearing and guide segments 22 and 24 extend between and fill substantially all of the space between the side wall 18 and the ring 38. This precludes accidental placement of an operator's fingers in existent spaces between individual spaced bearing elements and the ring 38, a possibility that has characterized some types of prior art tong structures and has resulted in injuries to operating personnel.

Figure 3:
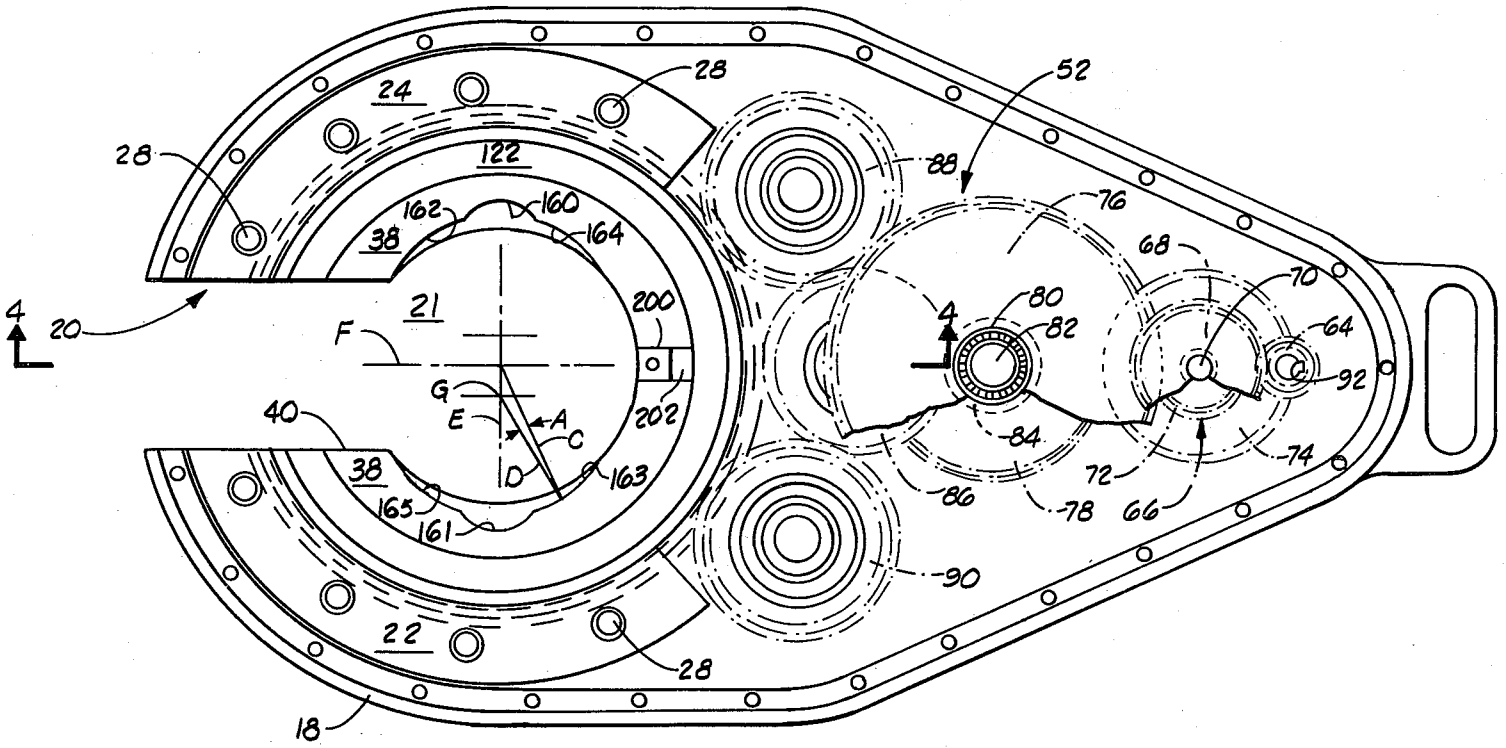
FIG. 3 is a plan view of the entire power tong of FIG. 1 with the top plate of the frame, the door and the die carrier removed in order to better illustrate the construction of the partial drive ring of the tong, and the manner in which it is mounted on the bearing and guide segments used in the present invention.
Figure 4:
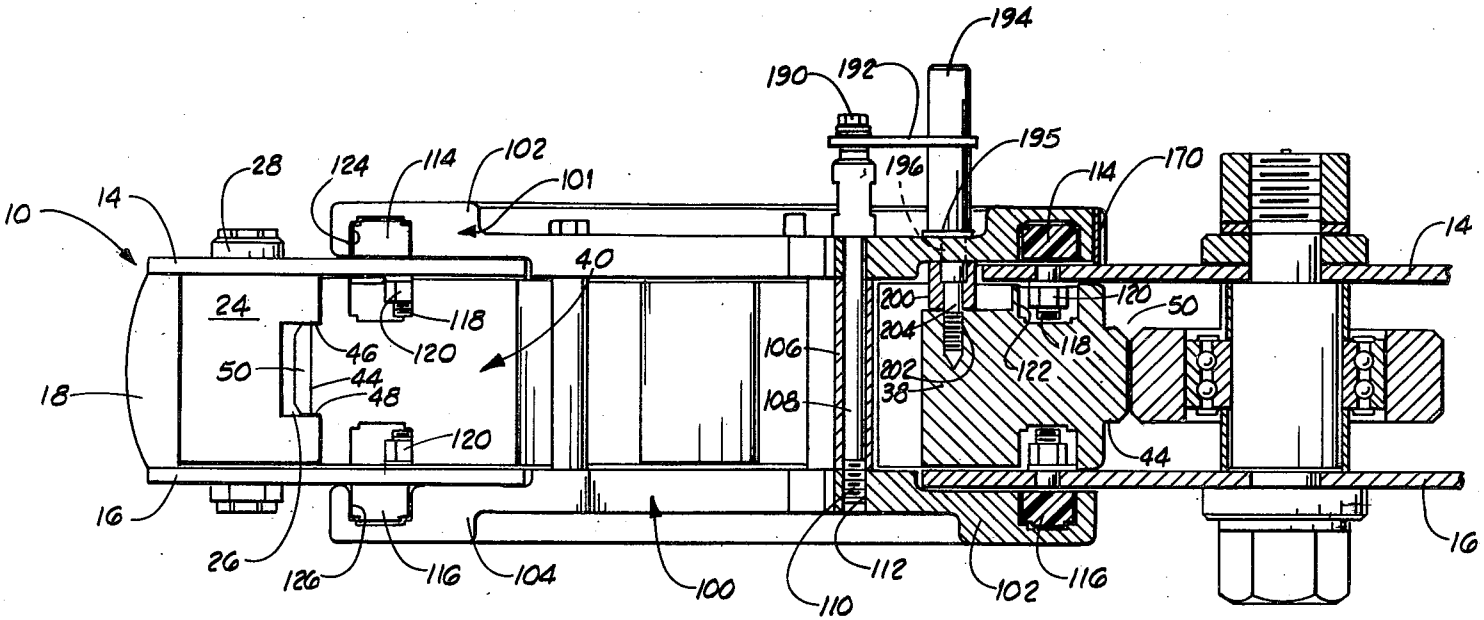
FIG. 4 is a vertical cross-sectional view taken along line 4—4 of FIG. 1.

The ring 38 is driven in rotation upon the frame 10 by means of a drive train 52 which is illustrated in FIGS. 3 and 4. The drive train 52 includes a motor drive gear 64 which engages a clutch assembly 66. More specifically, the motor drive gear 64 meshes with the clutch drive gear 68 which is rigidly attached to a clutch shaft 70. The clutch assembly 66 also includes a low speed clutch gear 72 and a high speed clutch gear 74 which can be selectively actuated by moving a shifting collar (not shown) which surrounds clutch shaft 70 by means of a conventional shifting assembly (not shown). The low and high speed clutch gears 72 and 74 mesh with low and high speed pinion gears 76 and 78, respectively. The low and high speed pinion gears 76 and 78 are carried by a sleeve 80 rotatably mounted upon a bearing post 82. The sleeve 80 includes gear teeth 84 which mesh with pinion idler gear 86. The pinion idler gear 86 in turn drives rotary idler gears 88 and 90 which mesh with the gear teeth 50 along the ring 38. The drive train is powered by a motor which has not been illustrated in the drawings. Such motors are conventional, however, and any suitable motor can be employed which has the capability of rotating the motor drive gear 64 in either direction. The drive shaft of the motor fits into the keyed opening 92 of the motor drive gear.

The mechanism used for gripping a pipe placed in the power tongs further includes a die carrier 100. The die carrier is rotatably mounted on the tong and has an opening 101 adapted for alignment with the throat 20 of the frame and the opening 40 of the partial ring. The die carrier 100 includes upper and lower arcuate plates 102 and 104, respectively, spaced apart by spacer sleeves 106. The plates 102 and 104 are held in position by bolts 108 which have a lower threaded end portion 110 which is threaded into a threaded opening 112 in the lower arcuate plate 104.

The upper and lower frame plates 14 and 16 of the frame 10 each has an annular bearing ring secured thereto, with the bearing rings being denominated by reference numerals 114 and 116. The bearing rings 114 and 116 are secured to the respective upper and lower surfaces of the upper and lower frame plates 14 and 16 by means of a plurality of countersunk bolts 118. The bolts 118 extend through openings in the upper and lower frame plates 14 and 16 and are retained by nuts 120 housed in grooves 122 formed in the upper and lower side of the drive ring 38. The annular bearing rings 114 and 116 ride in, and completely fill, grooves 124 and 126 of complementary shape defined in the lower and upper surfaces, respectively, of the upper and lower plates 102 and 104 of the die carrier 100, respectively. The upper and lower annular bearing rings 114 and 116 permit the drive ring 38 and the die carrier 100 to rotate relative to each other during operation of the tong. It will also be noted that, because the bearing rings 114 and 116 form continuous bearing surfaces extending around the central opening 21 of the frame, no opportunity exists for the operator's fingers to inadvertently slip in between separate spaced bearing rollers, and be crushed or cut off by the rotating die carrier 100.

The annular bearing rings 114 and 116 are of graphite impregnated, molded or cast polyurethane construction, and in this respect are constructed like the bearing and guide segments to which reference has hereinbefore been made. The polyurethane material used preferably has a Shore D hardness, as determined by testing method ASTM D-2240-68, of 70±2, and it preferably has a tensile strength of 5025±30 psi. The mix ratio is preferably 100 parts by weight of resin to about 60 parts by weight of catalyst. Less preferably, a hard polyurethane having a Shore A hardness of 95±5 and a viscosity 20 minutes after mixing of less than 4000 centipoise can be used. In the case of this less preferred composition, the mix ratio is preferably about 100 parts by weight of resin to about 38.8 parts by weight of catalyst. The bearing rings 114 and 116 and the arcuate bearing and guide segments 22 and 24 contain between three weight percent and ten weight percent powdered graphite which is thoroughly dispersed in the polyurethane prior to molding. About 8–10 weight percent content of the graphite is preferred.

A pair of link members 130 and 132 are pivotally mounted upon the die carrier 100 by the use of hinge pins 134 and 136, respectively. Each of the link members includes similarly shaped upper and lower arcuate wall portions. Only the upper wall portions 138 and 140 of the link members 130 and 132, respectively, are shown in the drawings. The link members also each include a cylindrically shaped side wall portion 142 and 143, respectively. The link members normally carry front dies 144 and 146, respectively, and rear dies 148 and 150, respectively. The dies are mounted on the side wall portions 142 and 143. Each of the link members 130 and 132 also includes head rollers 152 and 154, respectively, which are rotatably mounted by head roller pins 156 and 158, respectively, between the arcuate upper and lower wall portions and act as cam followers. The front and rear dies 144–150 are typically provided with serrated faces for the purpose of gripping the pipe section to be engaged by the power tong. Although front and rear dies have been illustrated, it will be appreciated that each of the link members 130 and 132 may only carry one die, with the dies mounted in opposed relationship. The inner surfaces of the side portion of the drive ring 38 facing the throat 20 are provided with three arcuate depressions on both sides of the pipe section. These depressions are positioned adjacent the link members 130 and 132. Depressions 160 and 161 serve as a neutral cam surface for receiving the head rollers 152 and 154, respectively, when the pipe-gripping mechanism is in its initial rest position. The depressions 160 and 161 serve as cam surfaces for urging the front dies 144 and 146 into gripping engagement with a pipe section at a time when the ring 38 has been rotated in a clockwise direction. The depressions 160 and 161, in like manner, urge the front dies into gripping engagement with the pipe section when the ring 38 is rotated in a counterclockwise direction.

The cam surfaces 162, 163, 164 and 165 have a specially designed and critical "cam angle" which must be employed in order to properly engage the front and rear dies with the pipe section. More particularly, in this particular preferred embodiment of power tong, the "cam angle" must be about ½° to 5½°, and is preferably 2° to 3° with 2½° being most preferred to obtain the most efficient gripping engagement in most pipe handling operations. The "cam angle" is defined as the angle formed by lines originating at the center of rotation of the partial drive ring 38 and a point on a line perpendicular to the center line of the throat 20 and passing through the center of rotation and terminating at the point on the cam surface at which the cam follower is positioned when the dies are in contact with a pipe section. The "cam angle" is illustrated as "A" in FIG. 3. The angle "A" is constructed as follows using the cam surface 163 as illustrative. A point "B" on the cam surface 163 is found at which the dies 144, 146, 148 and 150 engage the pipe. The point "B" is dependent on the pipe diameter and different sized link members 130 and 132 are used depending upon the pipe diameter. A line "C" is drawn between the center of rotation of the partial ring 38 and the point "B". A line "D" is then drawn between point "B" at the angle "A" from the line "C" so that the line "D" intersects a line "E" which is perpendicular to the center line "F" of the throat at a point "G" which is between the center of rotation of the partial ring 38 and the neutral cam surface 161 which is adjacent point "B". The cam surface 163 and also the cam surface 165 form a portion of a circle having a center at point "G". The cam surfaces 162 and 164 are constructed in a similar manner.

Referring now in more detail to the arrangement of the front and rear dies relative to the axis of rotation of the drive ring 38, FIG. 3 illustrates that a circle drawn about this axis may be divided into four quadrants by the center line "F" of the throat 20 and the line "E" passing through the axis of rotation perpendicular to the center line. The rear dies 148 and 150 are located in adjacent rear quadrants, and the front dies 144 and 146 are located in adjacent front quadrants of the circle. The link members 130 and 132 are so mounted that the cam surfaces urge the front dies 144 and 146 toward the pipe in an approximately radial direction. Accordingly, the front dies serve a dual purpose, namely, they not only grip the pipe section themselves but also urge the pipe section into engagement with the rear dies 148 and 150.

Mounted to the upper plate 14 of frame 10 is an arcuate brake band 170 having flanged portions 172. The flanged portions 172 are secured by means of bolts 174 to brackets 176 and function to retain the brake band in operative position. The brackets 176 are welded to the upper frame plate 14 and the bolts 174 are retained by nuts. The brake band 170 partially surrounds, and frictionally engages, the outer periphery of the upper plate 102 of the die carrier 100. The brake band 170 is restrained against a vertical movement by retainers 180 which are bolted at 182 to the upper frame plate 14. Spring 184 is attached to the brake band 170 at the rear end to slightly tension the brake band away from the die carrier 100. The brake band is constructed of a molded polyurethane material having fine wood chips, preferably mahogany wood, embedded therein. The polyurethane material employed for construction of the brake band preferably has a Shore A hardness of 95±5 and a viscosity 20 minutes after mixing of less than 4000 centipoise. It is prepared by mixing 100 parts by weight of resin with 38.8 parts by weight of catalyst. The embedded wood chips are preferably mahogany. The embedded chips range in size from fine sawdust size (about 1/64 inch in diameter) up to about ⅛ inch in diameter. These chips are embedded in the polyurethane as it is molded or cast to the brake band configuration which is generally in the form of a strap of from 1 inch to 3 inches in width and from 14 inches to 30 inches in length with a thickness of from about ¼ inch to about ½ inch. The mahogany wood chips impart excellent braking qualities to the band, and greatly increase its effective service life.

The bolt head of the rear bolt 108 is elongated to form a spacer. The top of the elongated head of bolt 108 has a threaded opening which receives the threaded end of bolt 190. Pivotally mounted on the bolt 190 is a retainer plate 192 which has an opening which receives backing pin 194. Backing pin 194 defines a shoulder 195 which retains the backing pin in the retainer plate 192. The backing pin 194 can be inserted into one of the openings 196 and 198 in the upper plate 102 of die carrier 100. Openings 196 and 198 are positioned one on either side of backing lug 200 when the opening 101 in the die carrier 100 is aligned with the opening 40 in the partial drive ring 38. The backing lug 200 is mounted in the recess 202 in the upper surface of the partial drive ring 38. The backing lug 200 is retained in place by a bolt 204 which is threaded into a threaded opening in the partial drive ring 38. The backing pin 194 abuts against the backing lug 200 and causes the partial drive ring 38 and die carrier 100 to move in unison with their openings 40 and 101, respectively, algined while the opening 40 in the partial drive ring 38 is being aligned with the throat 20 in the frame 10.

In the operation of the power tong of the invention, the opening 40 in the partial drive ring 38 is aligned with the throat 20 in the frame 10 so that a pipe section can be inserted into the interior of the partial ring. To insert the pipe, the door 30 is pivoted open to allow the pipe to be placed in the throat 20. The door is then closed. The exterior surface of the pipe section comes into contact with the rear dies 148 and 150 of link members 130 and 132, respectively. This contact imposes high impact forces upon the inner side of the die carrier 100, but this localized loading is absorbed and distributed by the annular bearing rings 114 and 116 much better than in prior constructions using a series of individual rollers. At this time, the longitudinal axis of the pipe section is approximately coincident with the axis of rotation of the partial drive ring 38. After the pipe section is in position, power is applied by the motor (not shown) to rotate the partial drive ring 38 either clockwise or counterclockwise. It may be assumed, for purposes of discussion and illustration, that the partial drive ring 38 is rotated in a clockwise direction.

Figure 2:
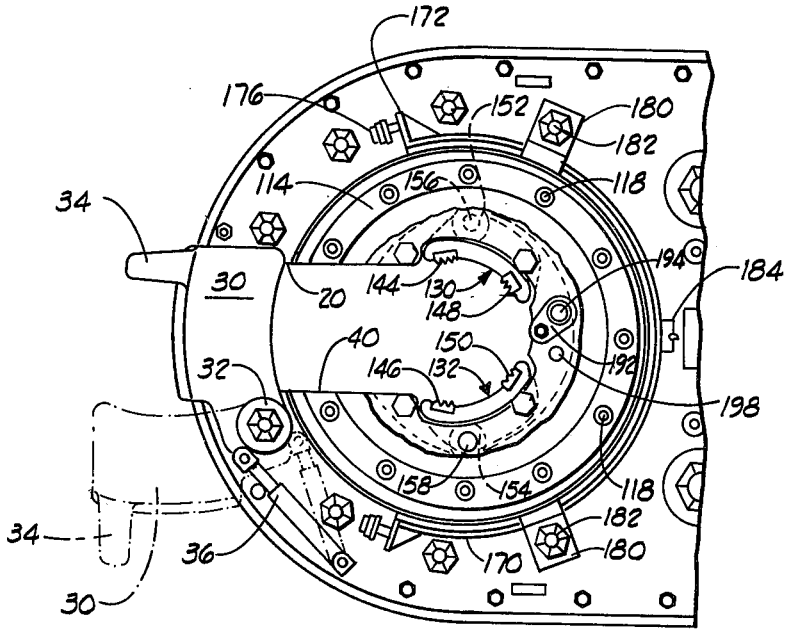
FIG. 2 is a top plan view similar to FIG. 1, but showing a part of the upper arcuate plate of the die carrier forming a part of the power tong removed.

As the drive ring 38 begins to rotate in a clockwise direction as viewed in FIG. 1, the die carrier 100 remains stationary because of the frictional engagement of the die carrier 100 with the mahogony chip impregnated polyurethane brake band 170. Therefore, the cam surfaces 162 and 163 on the partial drive ring 38 will move relative to the cam followers 152 and 154 on the link members 130 and 132, respectively. As the ring 38 continues to undergo rotation, the cam surface 162 causes the link member 130 to pivot counterclockwise about the hinge pin 134 upon which it is mounted, and in like manner, the cam surface 163 causes link member 132 to pivot in a clockwise direction about its hinge pin 136. These movements of the link members 130 and 132 will bring the front dies 144 and 146 into gripping engagement with the surface of the pipe section. Because of the specially designed cam surfaces and the carefully selected "cam angle", the force exerted by the dies on the pipe is concentrated at or near the center of rotation of the pipe section. The pipe is gripped tightly enough to allow proper torque to be applied without crushing or damaging the pipe.

After the front dies 144 and 146 are brought into contact with the pipe section, further movement between the cam followers 152 and 154 and the cam surfaces 162 and 163 is not possible. Accordingly, the die carrier 100 will begin to rotate in unison with the partial drive ring 38. Rotation of these elements is greatly facilitated over extended periods of usage by the bearing and guiding segments 22 and 24, and by the annular bearing rings 114 and 116. The pipe section, tightly gripped by the front and rear dies against relative movement with respect to the die carrier, also begins to rotate in a clockwise direction. Such rotation is continued for as many revolutions as are required to make up or break apart a threaded connection between one end of the pipe section and another pipe section positioned in alignment therewith, as such may be experienced with a pipe section retained in the rotary table of a drilling rig.

After the pipe section has been rotated sufficiently to make up or break apart the joint, the tong can be freed from the pipe section by rotating the drive ring 38 in the opposite direction, namely, in the counterclockwise direction in terms of the present discussion. This positions the cam followers 152 and 154 in the neutral cam surfaces 160 and 161, respectively. In this position, the front dies 144 and 146 may be disengaged from the pipe section and the tong may be moved rearwardly to free the rear dies 148 and 150 from contact with the surface of the pipe section. Thereafter, the ring 38 may be further rotated in a counterclockwise direction, if necessary, to position its opening 40 in alignment with the throat 20. The rotation of the ring 38 will also cause die carrier 100 to be rotated back into its initial rest position by reason of the cooperation between the backing pin 194 and backing lug 200 so that the pipe section may pass out of the tong.

The power tong of the invention, by reason of the replacement of the numerous heavy roller bearings and steel brake band employed in prior constructions with a much lighter polyurethane bearing structure and brake band, is easier to handle by the rig crew on a drilling rig, and weighs much less in terms of transport from one location to the other. Further, and more importantly, the particular geometry which characterizes the bearing and guide sectors which function to guide and support the partial drive ring 38 assures that negligible space is provided adjacent the drive ring, and between the power tong frame and the bearing segments, thus preventing grit and mud from penetrating or passing between the bearing and guide quadrants and the partial drive ring. There is thereby obviated, the effect of these deleterious materials in causing severe wear on the bearing surfaces of the bearing and guide quadrants, with the attendant requirement that the bearing elements of the tong be replaced at an early date. This construction, approaching in performance, a completely sealed bearing housing, permits the bearing elements employed to support and guide the partial drive ring so that the tong functions effectively over a much extended service life without the need for maintenance or replacement.

Finally, a very important aspect of the present invention is the fact that the manner in which the bearing and guide quadrants 22 and 24 are constructed, along with the particular geometry which characterizes the annular bearing rings 114 and 116, and the manner in which each of these elements are interfitted in the power tong frame and with respect to the respective steel moving elements of the mechanism which they guide and support, assures that there is a substantially reduced opportunity for fingers of operators to be caught between separate bearing elements and some of the moving parts of the power tong, thereby resulting in serious injuries.

Although certain preferred embodiments of the invention have been herein described, it will be understood that various changes and innovations in the described and illustrated structure can be effected without departure from the basic principles of the invention, and all such modifications are deemed to be circumscribed by the spirit and scope of the invention except as the same may be modified by the appended claims, or reasonable equivalents thereof.

What is claimed is:

1. A power tong for gripping a pipe section to make up or break a threaded connection between pipe sections comprising:

a frame having a central opening therethrough, and a pipe-receiving throat opening at one side of the frame into the central opening;

a partial drive ring rotatably mounted on said frame and defining an opening at one side thereof adapted for alignment with said throat in one position during rotation;

a pair of arcuate bearing and guide segments mounted on said frame at opposite sides of said drive ring and each defining a raceway recess receiving and slidably supporting an outer peripheral portion of said drive ring, each of said bearing and guide segments having a generally rectangular cross-section, with said recess located at the concave, radially inner side thereof, and each of said segments being of a solid molded or cast polyurethane having from about three weight percent to about ten weight percent graphite dispersed therein;

driving means mounted on the frame and drivingly engaging the partial drive ring at a location between said bearing and guide segments for driving the drive ring in rotation;

a die carrier rotatably mounted on the frame for rotation relative to both the frame and the drive ring;

die means carried on the die carrier for gripping a pipe placed in the central opening through the frame; and cam means between the die carrier and drive ring for actuating the die means into engagement with a pipe in said central opening upon partial rotation of the drive ring, and thereafter engaging said ring and die carrier with each other for concurrent rotation.

2. A power tong for gripping a pipe section to make up or break a threaded connection between pipe sections as defined in claim 1 wherein the polyurethane of each of said bearing and guide segments has a Shore D hardness of 70±2, and contains from about 8 to about 10 weight percent graphite.

3. A power tong for gripping a pipe section to make up or break a threaded connection between pipe sections as defined in claim 1 wherein each of said arcuate bearing and guide segments is curved through an arc exceeding 90° from one of its ends to the other.

4. A power tong for gripping a pipe section to make up or break a threaded connection between pipe sections as defined in claim 1 wherein said frame includes:

a top frame plate;

a bottom frame plate; and an outer peripheral side wall interconnecting said top and bottom frame plates and spaced radially outwardly from said partial drive ring;

and wherein each of said bearing and guide segments is positioned between said side wall and the drive ring and substantially entirely fills the radial space therebetween.

5. A power tong for gripping a pipe section to make up or break a threaded connection between pipe sections as defined in claim 1 and further characterized as including at least one graphite impregnated solid polyurethane bearing ring secured to said housing around said opening and rotatably supporting said die carrier on said housing.

6. A power tong for gripping a pipe section to make up or break a threaded connection between pipe sections as defined in claim 1 wherein said die carrier includes interconnected upper and lower arcuate plates on opposite sides of said frame; and wherein said tong further includes a pair of arcuate polyurethane bearing elements secured to the opposite sides of said frame and projecting into, and completely filling, mating arcuate bearing recesses in the corresponding upper and lower arcuate plates of said die carrier for rotatably supporting the die carrier on the frame.

7. A power tong for gripping a pipe section to make up or break a threaded connection between pipe sections as defined in claim 1 and further characterized as including an elongated brake band having its opposite ends secured to said frame, and having its central portion comformed to, and in braking contact with, a portion of said die carrier, said brake band being of a solid molded or cast polyurethane construction having wood chips embedded therein.

8. A power tong for gripping a pipe section to make up or break a threaded connection between pipe sections as defined in claim 5 wherein said bearing ring is constructed of polyurethane having a Shore D hardness of 70±2, and have from about 3 weight percent to about 10 weight percent of graphite dispersed therein.

9. A power tong for gripping a pipe section to make up or break a threaded connection between pipe sections as defined in claim 8 wherein each of said bearing segments is curved through an arc of about 120° and contains from about 8 weight percent to about 10 weight percent graphite.

10. A power tong for gripping a pipe section to make up or break a threaded connection between pipe sections as defined in claim 2 wherein each of said arcuate bearing and guide segments is carved through an arc exceeding 90° from one of its ends to the other.

11. A power tong for gripping a pipe section to make up or break a threaded connection between pipe sections as defined in claim 10 wherein said frame includes:

a top frame plate;

a bottom frame plate; and an outer peripheral side plate interconnecting said top and bottom frame plates and spaced radially outwardly from said partial drive ring;

and wherein each of said bearing and guide segments is positioned between said side wall and the drive ring and substantially entirely fills the radial space therebetween.

12. A power tong for gripping a pipe section to make up or break a threaded connection between pipe sections as defined in claim 11 and further characterized as including at least one graphite impregnated solid polyurethane bearing ring secured to said housing around said opening and rotatably supporting said die carrier on said housing.

13. A pipe-gripping power tong comprising:

a frame having a central opening therethrough, and defining a pipe-receiving throat at one side thereof opening through the frame into the central opening;

a drive ring rotatably mounted in the frame for rotation about the central opening and defining an opening alignable with said throat;

bearing and guiding means mounted in said frame on opposite sides of said central opening and cooperating with said drive ring to bearingly support said ring during its rotation;

means on the frame for driving the drive ring in rotation;

a die carrier rotatably mounted on the frame around the central opening in the frame for rotation relative to both the frame and the drive ring;

at least one bearing ring mounted on the frame and rotatably supporting the die carrier thereon, said bearing ring being of molded or cast polyurethane construction and having from three weight percent to ten weight percent graphite dispersed therein;

die means carried on the die carrier for gripping a pipe placed in the central opening through the frame; and cam means between the die carrier and the drive ring for actuating the die means into engagement with a pipe in the central opening upon partial rotation of the drive ring and thereafter engaging said ring and die carrier with each other for mutual rotation.

14. A power tong for gripping a pipe section to make up or break a threaded connection between pipe sections as defined in claim 13 wherein said polyurethane bearing rings contain from about 8 weight percent to about 10 weight percent graphite.

15. A power tong for gripping a pipe section to make up or break a threaded connection between pipe sections as defined in claim 13 wherein said die carrier includes:

an upper arcuate plate secured to one side of said frame and positioned around said central opening, said upper die carrier having an arcuate recess therein of complementary configuration to said bearing ring and receiving said one of said bearing rings in said recess; and a lower arcuate plate secured to the opposite side of said frame from said first arcuate plate and positioned around said central opening, said lower die carrier having an arcuate recess therein of complementary configuration to a second of said bearing rings and receiving another of said bearing rings in the recess in said lower arcuate plate.

16. A power tong for gripping a pipe section to make up or break a threaded connection between pipe sections as defined in claim 13 and further characterized as including a solid, flexible polyurethane brake band secured to said frame and including an arcuate medial position in contact with said die carrier means.

17. A power tong for gripping a pipe section to make up or break a threaded connection between pipe sections as defined in claim 16 wherein said solid, flexible polyurethane brake band has particles of wood embedded therein.

18. A power tong for gripping a pipe section to make up or break a threaded connection between pipe sections as defined in claim 14 wherein said solid polyurethane bearing rings each have a Shore D hardness of 70±2.

19. A power tong for gripping a pipe section to make up or break a threaded connection between pipe sections as defined in claim 13 wherein said bearing and guiding means comprises a plurality of rectangularly cross-sectioned, arcuate blocks of solid polyurethane having graphite dispersed therein and disposed on opposite sides of said central opening each of said blocks having a recess formed therein on the radially inner side thereof and slidably receiving an outer peripheral portion of said drive ring therein.

20. Apparatus for gripping and rotating a pipe comprising:

frame means defining a central opening through which a section of pipe can be extended;

means carried on the frame for gripping a pipe extended through the central opening, and then rotating the pipe about its longitudinal axis, said gripping and rotating means comprising:

a ring element around the opening rotatably mounted on the frame means and including cam surfaces thereon;

a pipe gripping assembly which includes:

a rotating element rotatably mounted on the frame means and rotatable relative to the ring element;

teeth-carrying pipe-gripping elements pivotally carried on said rotating element; and cam follower means mounted on and movable with said rotating element and connected to said pipe-gripping elements, said cam follower means bearing against and following said cam surfaces during relative rotation of said rotating element and said ring element; and bearing means secured to said frame means and rotatably supporting said ring element and said rotating element, said bearing means comprising:

a pair of annular bearing rings secured to opposite sides of the frame means around the opening therethrough, said bearing rings having said rotating element rotatably carried thereon, and each of said bearing rings comprising a solid body of polyurethane impregnated with graphite; and arcuate segments of solid polyurethane impregnated with graphite mounted on said frame means around said opening and each having a recess in the radially inner concave side thereof for receiving the outer peripheral edge of said ring element, each of said arcuate segments having an arcuate length which extends through at least 90° of arc; and power means mounted on said frame means and engaged with said ring element for driving said ring element in rotation.

21. A power tong for gripping a pipe section to make up or break a threaded connection between pipe sections as defined in claim 20 and further characterized as including an elongated strap of polyurethane having chips of mahogany wood embedded therein, said strap being mounted on said frame means bearing against said rotating element for braking the rotation of said rotating element.

22. Apparatus for gripping and rotating a pipe comprising:

a generally horizontally extending frame defining a central opening for receiving and holding a vertically extending section of pipe to be rotated, and having a throat opening through one side of the frame into the central opening;

means movably mounted on the frame for gripping and rotating a pipe extended through the central opening, said gripping and rotating means including a rotating element rotatably mounted on the frame;

an arcuate strap of solid polyurethane bearing against a portion of said rotating element for braking the rotation of said rotating element, said strap containing wood chips embedded therein having a size not larger than ⅛ inch in diameter; and drive means carried on said frame and drivingly connected to said pipe gripping and rotating means.

* * * * *